United States Patent [19]

Steinke

[11] 4,252,091

[45] Feb. 24, 1981

[54] GLOW PLUG CONSTRUCTION

[75] Inventor: Leo Steinke, Waiblingen-Hegnach, Fed. Rep. of Germany

[73] Assignee: Robert Bosch GmbH, Stuttgart, Fed. Rep. of Germany

[21] Appl. No.: 45,019

[22] Filed: Jun. 4, 1979

[30] Foreign Application Priority Data

Aug. 11, 1978 [DE] Fed. Rep. of Germany ..... 2835236

[51] Int. Cl.[3] ..... F02P 19/00

[52] U.S. Cl. ..... 123/145 A

[58] Field of Search ..... 123/145 A, 179 H

[56] References Cited

U.S. PATENT DOCUMENTS

| | | | |
|---|---|---|---|
| 2,086,548 | 7/1937 | Handforth | 123/145 A |
| 3,319,130 | 5/1967 | Betteridge | 123/145 A X |
| 4,087,904 | 5/1978 | Steinke et al. | 123/179 H X |
| 4,112,577 | 9/1978 | Mann | 123/145 A X |

FOREIGN PATENT DOCUMENTS

| | | | |
|---|---|---|---|
| 2637435 | 2/1978 | Fed. Rep. of Germany . | |
| 489225 | 1/1919 | France | 123/145 A |

*Primary Examiner*—Tony M. Argenbright

*Attorney, Agent, or Firm*—Frishauf, Holtz, Goodman & Woodward

[57] ABSTRACT

To positively exclude oxygen from a heating spiral located within the interior of a glow plug, so that the heating spiral can use a material having a high positive temperature coefficient of resistance, an insulating bushing separates a central connecting bolt from the surrounding metal sleeve and at least one, and preferably both the bolt and the metal sleeve are formed with circumferential matching ridges and grooves into which the insulating bushing will be pressed to provide an effective seal and a long, tortuous path for any possible leakage of air past the seal, even under the extremes of operating conditions and temperature gradients to which glow plugs are exposed in use. To further exclude oxygen from the heating spiral, the filler material adjacent the sealing bushing can include material having a high affinity to oxygen, such as aluminum or magnesium, so that any oxygen molecules which might leak past the seal will be bound thereby.

8 Claims, 4 Drawing Figures

GLOW PLUG CONSTRUCTION

The present invention relates to glow plugs for internal combustion engines, especially of the Diesel type, and more particularly to glow plugs of the type described in German Patent Disclosure Document DE-OS 26 37 435.

Glow plugs are used to preheat the combustion space for internal combustion engines of the Diesel type. The glow plugs are thus exposed to the intense heat and pressures which occur in the combustion region or chamber of the cylinder of the internal combustion engine.

THE INVENTION

It is an object to improve the lifetime of the glow plugs and their reliability.

Briefly, the glow plug has a metallic sleeve in which a resistance heating spiral is inserted, embedded in an insulating material. A connecting bolt is secured in the housing, insulated therefrom by means of a compressed sealing insulating bushing made of elastic material. In order to improve the corrosion resistance of the overall assembly, lifetime, and operating reliability, the connecting bolt and/or the metal sleeve are circumferentially deformed at least in the region in which the insulating bushing is positioned, for example by the formation of circumferential grooves, so that an effective seal with a long, tortuous path is provided which can be highly compressed. A material with high affinity to oxygen is located between the bushing and the outer end of the plug, retained, for example, by an O-ring, to block access of any oxygen to the interior of the plug and thus prevent premature burn-out thereof.

The glow plug has the advantage that the resistance heating element is effectively protected against damaging oxidation, since the seal which includes a long, tortuous path with high compression of the insulating material, is effectively gas-tight while still being capable of accepting the temperatures to which the glow plug and the components thereof are exposed and, additionally, the temperature gradients which occur along the length of the glow plug when it is inserted, with one end, into the combustion chamber of the engine, whereas the socket and the other end of the connecting bolt are outside of the engine block itself. The seal, then, will remain essentially gas-tight to prevent air, and specifically the oxygen in the air, from penetrating into the interior of the glow plug to damage the heating element therein.

Drawings, Illustrating Preferred Embodiments

Figure 1:
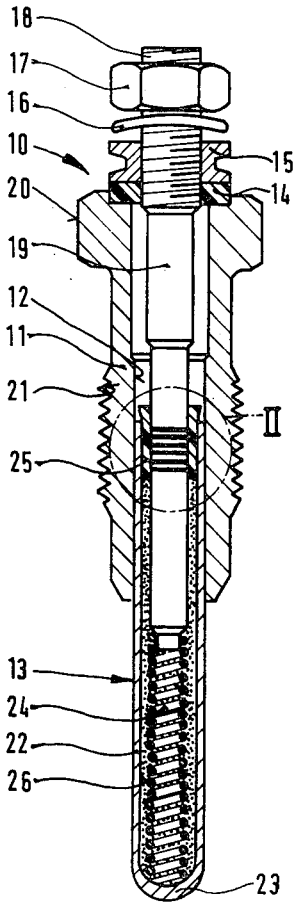
FIG. 1 is a schematic longitudinal cross section through a glow plug, to an enlarged scale.

The glow plug 10 (FIG. 1) has a metallic housing or socket 11 which has a longitudinal bore 12. The glow element 13 itself is secured in the socket 11 to be gas-tight, for example by being press-fitted therein. The diameter of the glow element 13 is in the order of about 6 mm. A connecting bolt 19 leads into the interior of the sleeve 13 to form an electrical connection to a heating spiral 24. Bolt 19 is threaded at its outer end. It is held in centered, insulated position on the socket 11 by an insulating washer 14, a holding nut 15 and further carries a bowed washer 16 and a connecting nut 17, which is threaded on the threaded end 18 of the bolt 19, for connection to a suitable source of current supply; the second terminal is formed by the socket 11 itself and, normally, forms the ground or chassis terminal in a motor vehicle. The electrical connecting bolt 19 is thus held in centered, insulating, spaced relationship within the bore 12 of the socket 11, and extends at the terminal end from the bore 12. The socket 11 has an outer hexagonal threading bead 20, for engagement with a suitable wrench so that the glow plug can be screwed with its thread 21 in a similarly tapped opening in the cylinder block of a Diesel engine (not shown).

The glow plug element 13 itself has a metal sleeve 22 of an approximate wall thickness of about 0.7 mm made of a refractory metal. The sleeve 22 is closed at the end or bottom 23, for example by welding. One terminal end of the heater spiral 24 is likewise welded to the bottom 23. The heater spiral 24 is positioned within the metal sleeve 22 and is made of a high melting metal, such as tungsten. Tungsten is not especially resistant to corrosion at high temperature. Rather than using tungsten, other materials could be used, such as a pure nickel, molybdenum, niobium, tantalum, all of which are materials having a high positive temperature coefficient of resistance. Upon being energized by electrical power, they rapidly reach a high temperature.

The other terminal end of the spiral 24 is connected to the end portion of connecting bolt 19 which extends into the metal sleeve. Preferably, the connection is by welding. To hold the bolt centered, and the spiral 24 in position, the space between the sleeve 22 and the spirals is filled with an electrically insulating, good heat-transmitting insulating material 26, for example a powder of magnesium oxide. The powder of magnesium oxide also, in part, fills the gap between the bolt 19 and the metal sleeve in that portion in which the bolt 19 extends into the sleeve 22—see FIG. 1. To hold the bolt reliably centered, and to define the gap between the bolt and the metal sleeve, a compressed sealing insulating ring 25 of electrically insulating elastic material is inserted between the bolt 19 and the open end portion of the metal sleeve 22. The material of insulating bushing 25, for example, is Viton, a fluor-based elastomer. The insulating powdery magnesium oxide material will fill the space between the separate respective windings of the resistance spiral 24 as well as between the spiral 24 and the metal sleeve 22 to reliably position the spiral 24 and prevent contact between it and the metal sleeve 22. Heat transfer through the insulating material 26 is improved, and the vibration and shock resistance of the entire glow plug 10 is enhanced by reducing the diameter of the glow plug element 13 in known manner by circular hammering or swaging, thereby compressing the insulating material and forming it into a dense mass within the metallic sleeve 22.

The materials of which the resistance spiral 24 is made are sensitive with respect to corrosion. To obtain good lifetime, oxygen must be prevented from access to the interior of the metal sleeve 22. A reliable gas-tight, that is air-tight, seal must therefore be provided. In accordance with the invention, the connecting bolt 19 is formed with circumferential grooves 27—see FIG.

Figure 2:
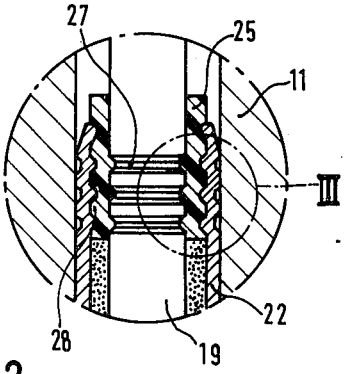
FIG. 2 is a fragmentary view of the plug of FIG. 1, and shows that portion enclosed within the circle II of FIG. 1 to an enlarged scale.
Figure 3:
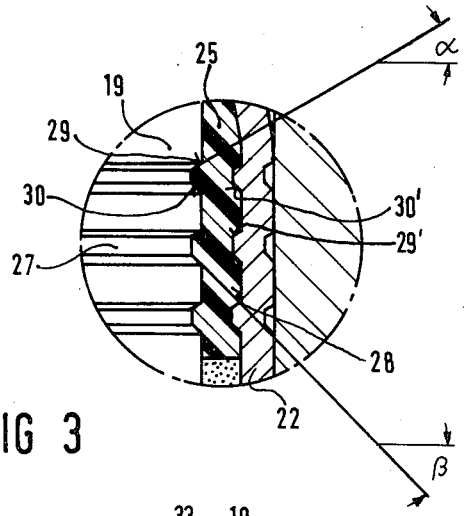
FIG. 3 is a fragmentary view of a portion of FIG. 2 and shows, to a still more enlarged scale, the portion within the circle III of FIG. 2.

2—in the region of the bolt 19 in which the sleeve 25 surrounds the bolt 19 and, preferably and as shown in FIGS. 2 and 3, in which a common zone between the insulating ring 25, the bolt 19, and the metal sleeve 22 will arise. Reduction of the diameter of the glow element 13 simultaneously effects insertion of the insulating material of the ring 25 into the grooves 27 of the bolt 19, thereby resulting in an increased sealing surface of the sealing range or sealing zone which is of limited length in view of the limited axial extent of the sealing ring or bushing 25. The connecting bolt 19, in the range of the sealing bushing, has a diameter of about 3.6 mm and, preferably and as shown in FIGS. 1–3, has about three circumferential grooves 27, which have a depth of 0.1 mm and essentially are of trapeze-shaped cross section. The edges of the grooves 27 are rounded in order to prevent fatigue or cracks or other faults due to notches and cuts which may also arise on the insulating ring 25. Five of such grooves 27 have a particularly good sealing effect—increasing the number of grooves, of course, increases the undulating sealing surface which will result. Five such grooves of an average width of smaller than 1 mm, and spaced about 2 mm or less from each other, have been found to have excellent and best sealing effect with a suitable length of the sealing bushing 25.

FIG. 2 additionally shows similar grooves 28 formed in the metal sleeve 22 which, additionally, increase the sealing surface and which have the same or similar shape or configuration as the grooves formed in the bolt 19. Some types of glow plugs operate satisfactorily if the bolt 19 alone has the grooves 27 therein, and the glow plug sleeve 22 is straight (FIG. 1); for other types of glow plugs—the type depending largely on association with the engine, its size and cylinder combustion space design, operate more effectively with grooves 28 also formed in the sleeve 22 (FIG. 2).

FIG. 3 shows an arrangement in which the bolt 19 has grooves 27 formed therein; the sleeve 22 has grooves and projections 28 formed therein. Additionally, the grooves 27 and 28 are specially shaped in order to prevent creep of the insulating bushing 25. This is obtained by making the angles in the respective axial direction different; the flanks 29 of the grooves 27, which correspond to the flanks 29' of the inner projections defining the grooves 28, have an angle $\alpha$ which is more acute than the angle $\beta$ of the corresponding flanks 30, 30' facing the end 23 of the glow element 13. The grooves 27 of the bolt 19 can be fabricated by compression-working of the bolt 19 so that the immediately surrounding portion adjacent the grooves will have a diameter slightly greater than the nominal diameter of the bolt 19, by forming small projecting beads. These slightly projecting edges (not clearly visible in the drawing)—projecting adjacent the grooves 27—additionally prevent creep of the plastic bushing 25 which, generally, is formed as a short piece of tubing.

Figure 4:
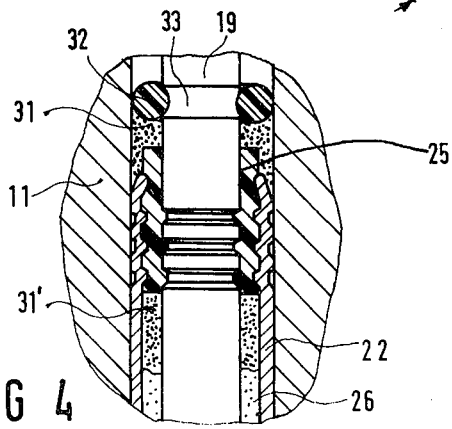
FIG. 4 is a view similar to FIG. 2 and showing an additional sealing structure.

FIG. 4 shows a sealing arrangement which, in general, corresponds to the previously described embodiment but, in order to further improve the sealing, includes further insulation material 31, 31' which is placed adjacent the insulation powder 26. The material 31, 31' has a high affinity to oxygen and may, for example, include the same magnesium oxide used for the filling 26 and, additionally, aluminum or magnesium powder added thereto. The filling 31, 31' thus can bind oxygen which might penetrate through an outer sealing ring 32, in form of an O-ring, placed in a groove 33 located axially upwardly from the end of the sleeve or bushing 25 on the bolt 19. The sealing filling 31, 31' thus prevents oxygen from reaching the zone in which the corrosion-sensitive heating spiral 24 is located. The material 31' is located in the space between the material 26 and the lower end of the insulating bushing 25, the bolt 19 and the interior of the sleeve 22. The material 31 is located in the space between the bolt 19, the socket 11, the upper end of the bushing 25 and of the sleeve 22 and, axially upwardly, the O-ring 32 in the groove 33 of bolt 19.

The arrangement of materials 31, 31', either or both, has the functional advantage of still better corrosion resistance of the overall plug. In most instances, however, it is sufficient to use a plug which has only one of the materials 31 or 31' in the respective locations. In a preferred embodiment, only the region of the material 31' is used, to save the costs of the additional groove 33 and the O-ring 32, and the manufacturing step in filling that region.

The glow plugs referred to are illustrated in FIG. 1 as heater-type flow plugs; it is, of course, possible to use the same construction with combustion-type glow plugs or flame-type glow plugs in which the glow plug itself, additionally, has a fuel supply.

Various changes and modifications may be made, and features described in connection with any one of the embodiments may be used with any of the others, within the scope of the inventive concept.

I claim:

1. Glow plug for an internal combustion engine comprising a metallic housing or socket (11) formed with a longitudinal bore (12) therein; a glow element (13) secured in said bore in gas-tight connection, and extending from the housing or socket, adapted to be introduced into the combustion chamber of the internal combustion engine;

the glow element (13) including a thin-walled metal sleeve element (22) of heat-resistant material, a resistance heating spiral (24) within the metal sleeve element and comprising a material having a high positive temperature coefficient of resistance, the resistance heating spiral being connected at one end with an end portion of the metal sleeve element (22), a connecting bolt element (19) inserted in said metal sleeve element (22), and connected to the other end of the resistance heating spiral a filling of insulating, heat-conductive material within said metal sleeve element (22), surrounding said resistance heating spiral (24) and spacing the portion of the connecting bolt element (19) extending within the metal sleeve element (22) therefrom, and a sealing and insulating bushing (25) secured within the metal sleeve element (22) and the bolt element (13), insulatingly spacing the bolt element from the metal sleeve element and preventing an electrical connection to the other end of the resistance heating spiral, at least one of said elements being formed with surface deformations in the shape of circumferentially extending grooves (27, 28) and ridges in the region of engagement with the insulating bushing (25) and deforming the bushing, whereby the bushing will have an extended surface between said elements;

and wherein, in accordance with the invention, the filling material (31, 31') in a region adjacent the insulating bushing (25) comprises a material having a high affinity to oxygen.

2. Glow plug according to claim 1, wherein the grooves (27, 28) in at least one of said elements (19, 22) are, essentially, trapeze-shaped in cross section.

3. Glow plug according to claim 2, wherein the flanks (29, 29') of at least one of the grooves (27, 28) at one side are steeper than the opposite flanks (30, 30').

4. Glow plug according to claim 3, wherein the flanks (29, 29') remote from the closed end (23) of the glow element are steeper than the opposite flanks (30, 30').

5. Glow plug according to claim 1, wherein both said metal sleeve element (22) and said connecting bolt element (13) are formed with said surface deformations.

6. Glow plug according to claim 1, wherein the filling material having a high affinity to oxygen is located, at least in part, in the region adjacent the bushing and between the bolt element (19) and the housing (11) and remote from the closed end portion (23) of the metal sleeve element (22);

and sealing and retaining means (32, 33) are provided sealing said filling material in position adjacent said bushing and between the bolt element (19) and the housing (11).

7. Glow plug according to claim 6, wherein said filling material comprises magnesium oxide and a powder comprising at least one of the materials of the group consisting of: aluminum, magnesium; added to the magnesium oxide.

8. Glow plug according to claim 1, wherein the filling material having a high affinity to oxygen comprises magnesium oxide and a powder comprising at least one of the materials of the group consisting of aluminum, magnesium; added thereto, said filling material being located in the region between the bolt element (19) and the housing (11), and adjacent the bushing remote from the closed end portion (23) of the metal sleeve element (22);

and sealing and retaining means (32, 33) are provided sealing said filling material in position adjacent said bushing and between the bolt element (19) and the housing (11).

* * * * *